United States Patent [19]

Khaidurov et al.

[11] 3,988,963

[45] Nov. 2, 1976

[54] SAFETY DEVICE WHICH ARRESTS THE HAMMER AND BLOCKS THE SIGHT

[76] Inventors: Efim Leontievich Khaidurov, ulitsa Glagoleva, 25, korpus 2, kv. 138, Moscow; Vladimir Alexandrovich Razorenov, ulitsa Ponomareva, 4a, kv. 51, Minsk; Sergei Sergeevich Bulanov, ulitsa Pushkinskaya, 204, kv. 28; Oleg Mikhailovich Gorbov, ulitsa Kirova, 118, kv. 4, both of Izhevsk, all of U.S.S.R.

[22] Filed: June 24, 1974

[21] Appl. No.: 482,599

[52] U.S. Cl. ..... 89/148; 42/70 F; 42/75 C

[51] Int. Cl.[2] ..... F41C 17/04

[58] Field of Search ..... 42/7, 70 F, 75 C; 89/148, 194, 195, 197, 199

[56] References Cited

UNITED STATES PATENTS

| | | | |
|---|---|---|---|
| 1,025,132 | 5/1912 | Douglas | 89/148 |
| 1,407,959 | 2/1922 | Stokke | 89/195 |
| 3,711,980 | 1/1973 | Palama | 89/197 |
| 3,757,634 | 9/1973 | Uria et al. | 42/70 F |

*Primary Examiner*—Stephen C. Bentley
*Attorney, Agent, or Firm*—Haseltine, Lake & Waters

[57] ABSTRACT

A pistol having a frame with guideways for reciprocation of the slide at firing of this pistol, the guideways being separate from each other, one of these guideways having two bearing surfaces adjoining the surface of the slide at the bottom side of the latter and the other guideway having one bearing surface adjoining the respective surface of the slide at the top side of the latter, the other guideway being arranged atop the slide and being connected with the frame so that it is removable upon disassembly of the pistol.

6 Claims, 15 Drawing Figures

SAFETY DEVICE WHICH ARRESTS THE HAMMER AND BLOCKS THE SIGHT

The invention relates to firearms and, more particularly, it relates to a self-loading match pistol having an unlocked slide or breech.

There are widely known self-loading match pistols having a frame supporting thereon a barrel and a slide locking the bore of the barrel. The same frame supports thereon a firing and trigger mechanism, a magazine and a base with a sighting mechanism.

To provide for reciprocation of the slide at firing of the pistol, the frame of the pistol has guideways in the form of a pair of rectangular grooves made in the opposite lateral sides of the frame. The top and bottom surfaces of these grooves act as the bearing surfaces of the guideways. The slide has at the lateral sides thereof lugs matching with these grooves in the frame, these lugs cooperating with the bearing surfaces of the guideways at reciprocation of the slide.

A disadvantage of the abovedescribed known self-loading match pistols is the fact that the guideways, i.e. the grooves are made along a portion of the frame, having a considerable length, this length being determined by the length of the slide and the stroke of its reciprocation. The abovementioned lugs extend over the entire length of the slide. With the grooves of the frame and the matching lugs of the slide being of the above structure, they are to be manufactured with sufficient accuracy, which involves considerable difficulty in production of the pistol. Furthermore, during the service life of the pistol any slight contamination of the guideways with powder residue involves delays in the process of firing, on account of hampered interaction of the cooperating assemblies and parts of the pistol. Such drawbacks are particularly unpleasant in cases when firing should be rapid, e.g. in cases of firing at silhouette targets.

It is an object of the present invention to provide a self-loading match pistol wherein the guideways for reciprocation of the slide a firing should be of a structure providing for dependable, practically undelayed reciprocation of the slide therealong, which, in turn, should promote precise interaction of the parts and assemblies of the pistol at firing.

It is another object of the present invention to provide guideways whose manufacture presents no technological difficulties.

With these and other objects in view, there is disclosed a self-loading match pistol wherein the frame supports thereon a base with a sighting device, a firing and trigger mechanism and guideways for reciprocation of the slide therealong at firing, these guideways having bearing surfaces parallel to the bore of the barrel of the pistol and adapted to cooperate with the respective matching surfaces of the slide, in which pistol, in accordance with the present invention, these guideways are separate from each other, one of them having two bearing surfaces matching with the surface of the slide at the bottom side of the latter, while the other guideway has a single bearing surface matching with the respective surface of the slide at the top side of the latter, this other guideway being positioned atop the slide and connected with the frame so that this other guideway is removable upon disassembly of the pistol.

It is expedient that the guideway positioned atop the slide should be formed by a part eneveloping the slide and having a pair of projections at each one of the two opposite ends thereof, adapted to be received in corresponding grooves made in the said base and said frame, the side of this part, adjoining said frame, having made therein a cutaway portion for ejection of the shell of a fired cartridge therethrough.

The abovespecified guideway is structurally simple and can be readily manufactured.

Alternatively, it is expedient that the guideway positioned atop the slide should be formed by the said base having a channel made therein, complementary to the shape of the slide, and by a plate adjoining this base and rigidly fixed thereto at firing, the plate being pivotable at assembling and disassembling of the pistol.

With the guideway positioned atop the slide being of the last-mentioned structure, it can be used as a safety means preventing accidental firing.

A self-loading match pistol constructed in accordance with the present invention is simple in manufacture and provides for dependable, practically undelayed reciprocation of the slide along the guideways at firing, which, in its turn, promotes reliable performance of the firing and trigger mechanism.

Other objects and advantages of the present invention will be made apparent in the description of embodiments of a self-loading match pistol in accordance with the present, given hereinbelow with reference being had to the accompanying drawings, wherein.

Figures 1, 2, 3, 5:
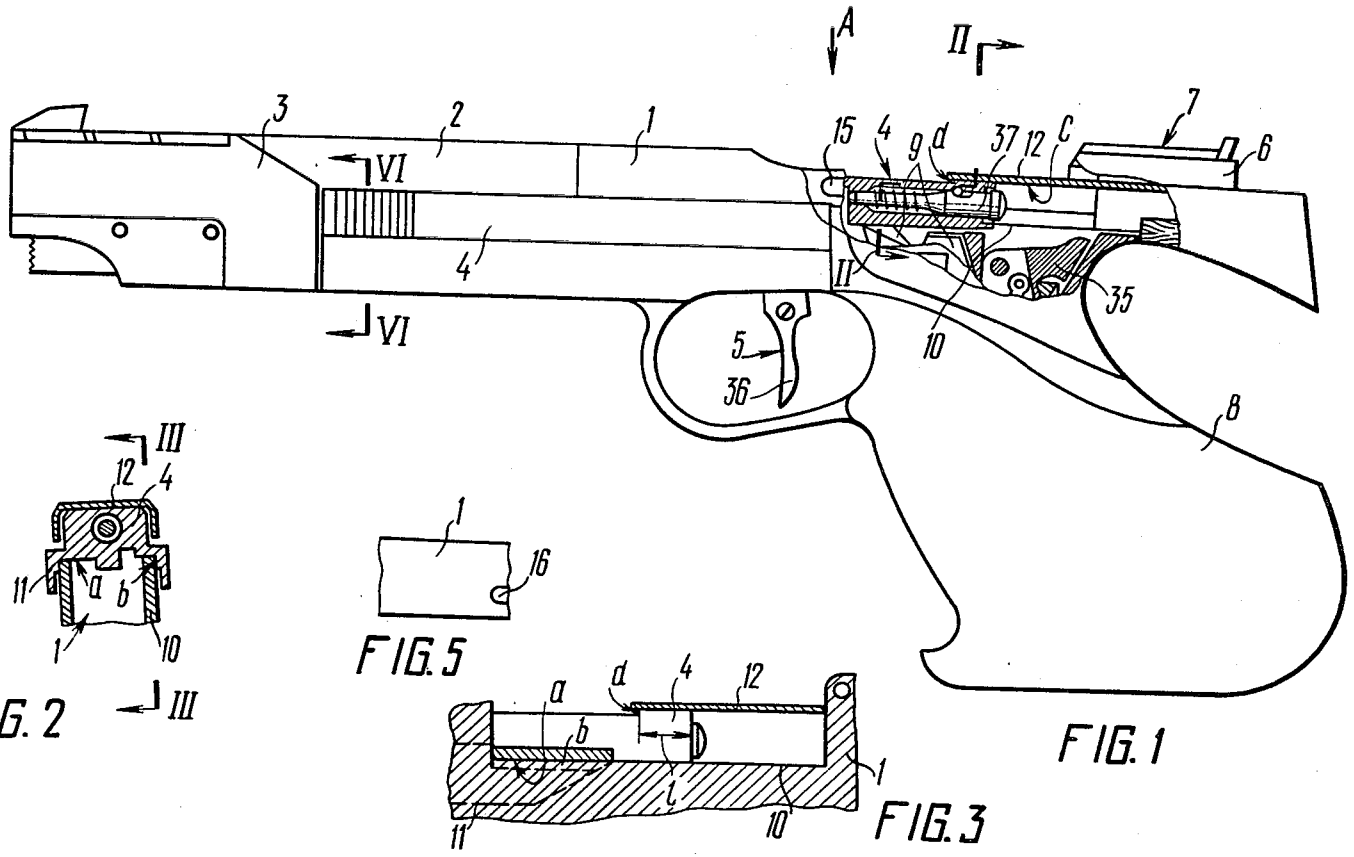
FIG. 1 is a side view, partly broken away, of a self-loading match pistol in accordance with the invention.
FIG. 2 is a sectional view taken along line II—II in FIG. 1.
FIG. 3 is a sectional view taken along line III—III in FIG. 2.
FIG. 5 is a view taken along arrow line A in FIG. 1.

Referring now in particular to the appended drawings, the self-loading match pistol according to the first embodiment of the invention includes a frame 1 (FIG. 1) supporting thereon a barrel 2 with a compensator 3.

The frame 1 further supports thereon a slide 4 adapted to close off the bore of the barrel 2 and a firing and trigger mechanism 5. The base 6 which forms a part of the frame 1 has mounted thereon a sighting device 7. The frame 1 has mounted thereon the side plates 8 of the hand grip and the magazine 9.

To support the reciprocating slide 4 at firing, the frame 1 has formed thereon a guideway 10 (FIGS. 2 and 3) having a two planar bearing surfaces parallel to the bore of the barrel 2 (FIG. 1) and spaced from each other. The bearing surfaces of the guideway 10 (FIGS. 2 and 3) cooperate and match at reciprocation of the slide 4 with the respective bearing surfaces *a* formed on the bottom side of the slide 4. These surfaces of the slide 4 are also planar, the slide 4 being retained against lateral displacement by lateral shoulders 11 of which the internal surfaces *b* cooperate with the external lateral surfaces of the guideway 10. These shoulders are formed at the rear portion of the slide and extend over a relatively limited length, as can be seen in FIG. 3.

Figure 4:
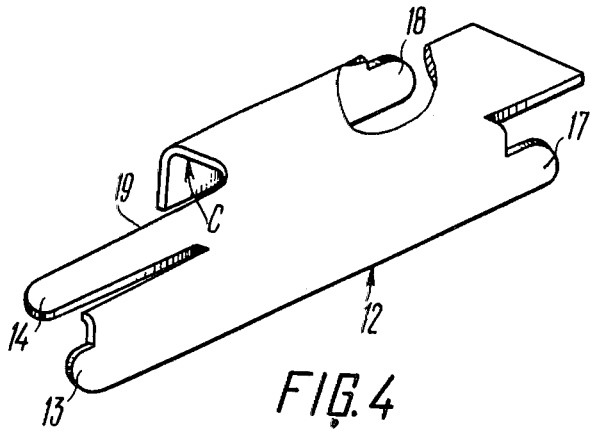
FIG. 4 is a enlarged perspective view of the guideway positioned atop the slide.

The other guideway 12 (FIGS. 2, 3) is positioned atop the slide 4 and is formed by a separate part shown in more detail in FIG. 4, this part embracing the upper portion of the slide 4 and being channel-shaped in cross-section.

The surface *c* of this part 12 is a bearing surface matching and cooperating with the bearing surface of the slide 4 (FIG. 1) at the top side thereof.

To reduce the area of friction between the respective cooperating surfaces of the guideway 12 and the slide 4, the latter has on the top side thereof a bearing seat *d* extending over the length *l* (FIG. 3) of the slide 4.

The guideway 12 (FIG. 1) has one end thereof supported by the frame 1 and the other end thereof supported by the base 6. This guideway 12 is fixed on the frame 1 by means of projecting tabs 13 (FIG. 4) and 14 separated by a slit ensuring the required resilience of the flap 14.

To receive these tabs 13 and 14, the frame 1 (FIG. 1) has made therein respective grooves 15 and 16 (FIG. 5). The opposite end of the guideway 12 (FIG. 4), adjoining the base 6 (FIG. 1), has a pair of tabs 17 (FIG. 4) and 18, the base 6 (FIG. 1) having made therein corresponding grooves (not shown) to accommodate these tabs. At the side thereof, adjoining the frame 1, the guideway 12 has a cutway portion 19 (FIG. 4) through which the shell of a fired cartridge can be ejected.

Figure 6:
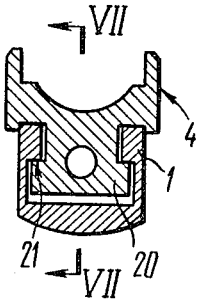
FIG. 6 is a sectional view taken along line VI—VI in FIG. 1.
Figure 7:
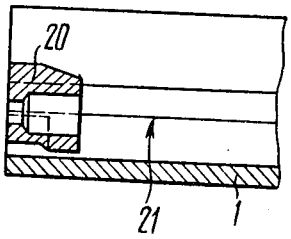
FIG. 7 is a sectional view taken along line VII—VII in FIG. 6.

The foremost (in the drawing) end portion of the slide 4 is provided with a lug 20 (FIGS. 6, 7) against which the return spring (not shown) of the slide 4 bears in the assembled state of the pistol. This lug is T-shaped in cross-section and is receivable in guideways 21 made in the frame 1 and being in cross-section of a shape complementary to that of the lug 20.

Figure 8:
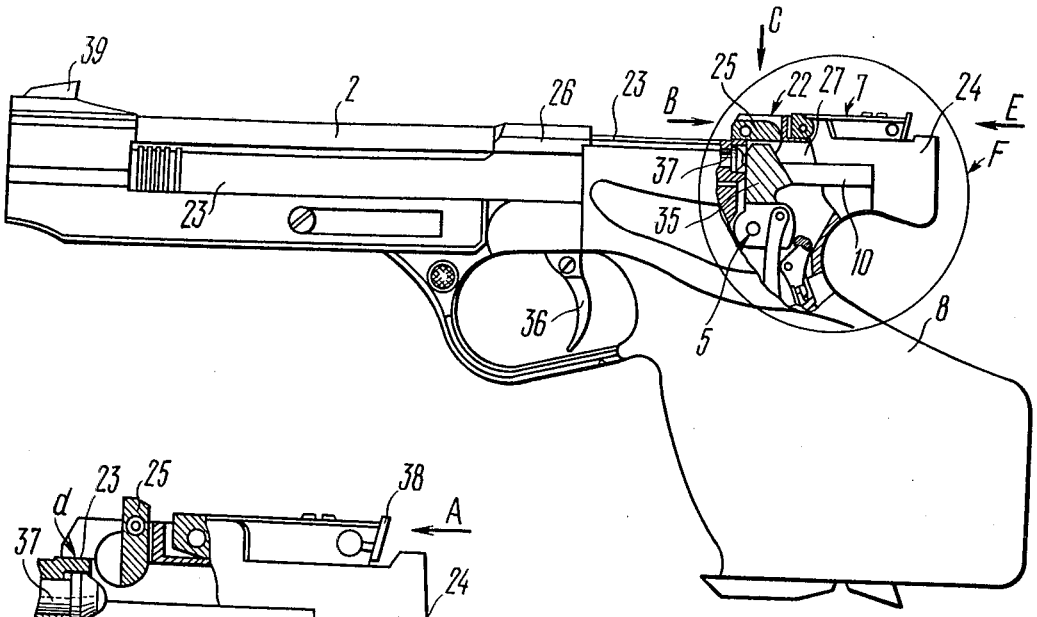
FIG. 8 is a side view partly broken away view of a self-loading match pistol, illustrating an alternative embodiment of the present invention.

In accordance with an alternative embodiment of the present invention, the guideway 22 (FIG. 8) positioned atop the slide 23 is formed by the base 24 and by a plate 25 adjoining the base 24. The base 24 is rigidly secured to the frame 26 of the pistol and has a channel 27 therein (FIGS. 8, 13) of a cross-sectional shape complemantary to that of the slide 23.

The top wall of the channel 27 and the bottom surface of the plate 25, adjoining the respective surfaces of the slide 25, are the bearing surfaces of the guideway 22.

Figure 9:
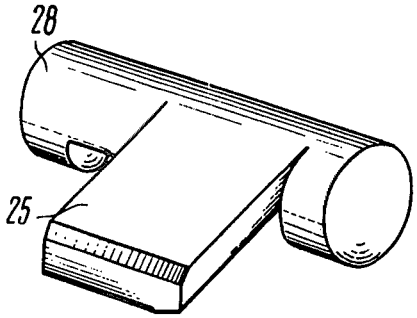
FIG. 9 is an enlarged perpective view of the plate of the guideway positioned atop the slide.
Figure 10:
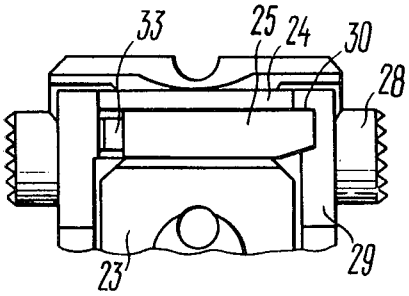
FIG. 10 is an enlarged view taken along arrow line B in FIG. 8.
Figure 11:
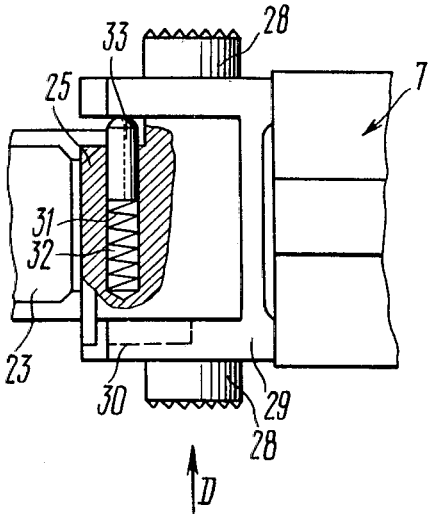
FIG. 11 is an enlarged view partly broken away taken along arrow line C in FIG. 8.

The plate 25 (FIG. 9) has a rectangular portion integral at one end thereof with a pair of journals 28 serving to connect the plate 25 with the base 24 (FIGS. 10, 11)

Figure 12:
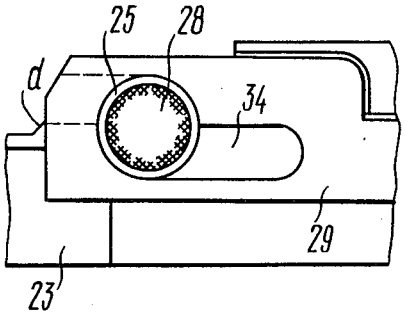
FIG. 12 is a view taken along arrow line D in FIG. 11.

With the slide 23 being in its foremost position (in the direction of the aiming line), the plate 25 bears upon the seat *d* (FIGS. 12, 14) of the slide, similar to the seat *d* of the slide 4 of the embodiment described herein-above in connection with FIG. 1. The length of the plate 25 (FIG. 8) is such that with the slide 23 in the foremost position the plate does not extend beyond the seat *d* and thus does not interfere with ejection of the shell of a fired cartridge.

To secure the plate 25 on the base 24, the latter has thereon a pair of parallel jaws 29 (FIGS. 10, 11, 12) accommodating the plate 25 therebetween and having coaxial openings therein receiving the respective journals 28 of the plate 25. Thus, the plate 25 is pivotable in these openings on its journals 28. One of the jaws 29 has a longitudinal groove 30 therein (FIGS. 10, 11) of a trapezoidal shape in cross-section, as can be seen in FIG. 10. The plate 25 has the respective side portion thereof received in this groove 30 and retained therein at firing by the effort of an extension spring 31 (FIG. 11) received in a blind hole 32 in the plate 25 and cooperating with a cylinder-shaped plunger 33 compressing this spring.

One of the jaws 29 (the left-hand one in the direction of aiming) has therein a through slot 34 (FIG. 12) through which the plate 25 can be introduced between the jaws 29 and removed therefrom.

The herein disclosed self-loading match pistol operates, as follows.

Upon a shot having been fired, the slide 4 (FIG. 1) recoils rearwardly, its bottom side sliding along the respective surfaces of the guideway 10 and its top side sliding along the guideway 12, and cocks the hammer 35 of the firing and trigger mechanism 5. Thereafter the return spring (not shown) sends the slide 4 formardly, the latter feeding a successive cartridge from the magazine 9 into the cartridge chamber of the barrel 2. Upon the successive pulling of the trigger 36, the hammer 35 strikes the firing pin 37 of the slide 4, and the firing cycle repeats itself. The guideways 10 and 12 having plain planar bearing surfaces contacting the slide 4, the powder residue and the grease coming from the cartridges can not practically settle thereon, which promotes reliable performance of the pistol, since this performance depends on automatic interaction of the slide 4 with the parts of the firing and trigger mechanism 5 and magazine 9.

To disassemble the pistol, the resilient tab 14 (FIG. 4) is depressed, to withdraw thereafter the tab 13 from the groove 15 (FIG. 1) and also to withdraw the tabs 17 and 18 from the corresponding respective grooves of the base 6.

Figure 14:
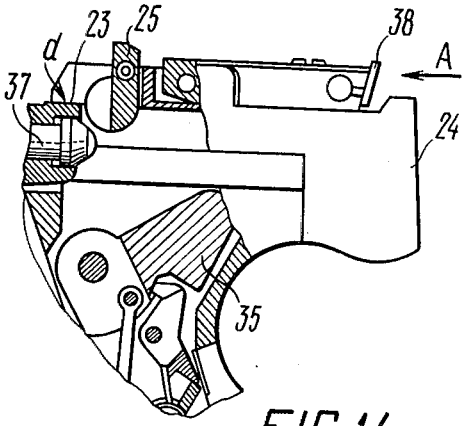
FIG. 14 shows in more detail the area F in FIG. 8 with the strip pivoted and the hammer cocked.
Figure 15:
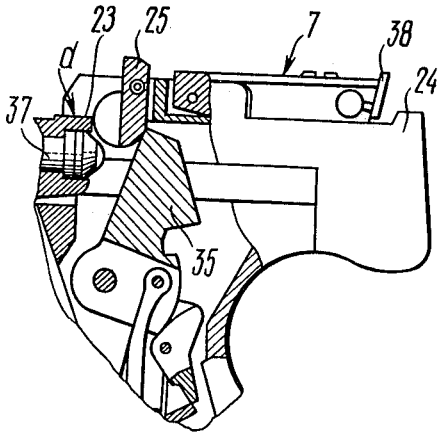
FIG. 15 is a view similar to that in FIG. 14, with the hammer released.
Figure 13:
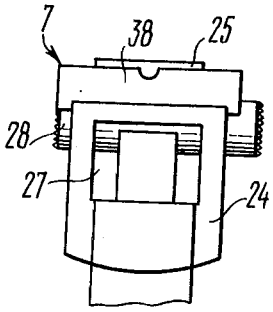
FIG. 13 is an enlarged view taken along arrow line E in FIG. 8.

The pistol described as the second embodiment of the present invention and incorporating the guideway 22 (FIG. 8) operates at firing similarly to the pistol described hereinabove. However, with a cartridge fed into the cartridge chamber, should it be necessary to delay firing, the lefthand journal 28 (FIGS. 10 and 11) of the plate 25 is depressed to displace the plate 25 from the groove 30 in the jaw 29 of the base 24, whereafter the plate is pivoted into a vertical position, as can be seen in FIGS. 13, 14 and 15. In this position the plate 25 is retained by friction provided by the action of the plunger 33 loaded by the abovedescribed associated spring. In this position of the plate 25 the cylindrical surface of the latter, adjoining the base 24, is in the path of the hammer 35 toward the firing pin 37. The opposite end of the plate 25 projects above the sighting device 7, interrupting the aiming line, i.e. the foresight 40 (FIG. 8) can no longer be seen in the slit of the back sight 38 (FIG. 13). If the trigger is pulled accidentally, the cartridge would not be fired, because the hammer would be arrested by the plate 25. When the sportsman prepares to reopen fire, the impossibility of firing the pistol will be indicated by the plate 25 projecting above the sighting device 7. To resume firing, the plate 25 is turned into its horizontal position, until it enters the groove 30. If the hammer is fully cocked, the successive shot is fired by pulling the trigger 36. If the hammer has been arrested by the cylindrical surface of the plate 25, upon the rotation of the plate 25 into the horizontal position, the firing spring (not shown) rotates the hammer until it abuts against the firing pin 37.

In the last-described case the hammer is to be cocked by pulling the slide 23 rearwardly.

It can be seen from the above disclosure that the plate 25 which is a part of the guideway 22 serves as a safety device, when it is rotated into its vertical position.

What we claim is:

1. A self-loading match pistol comprising: a frame; a barrel supported by said frame and having a bore; a slide adapted to close off the bore of said barrel and supported by said frame for reciprocation therealong; a firing and trigger mechanism mounted on said frame; a base supported by said frame; a sighting device mounted on said base; one guideway on said frame for said slide for reciprocation therealong during firing and including two bearing surfaces parallel to the bore of said barrel and cooperating with the surface of said slide at the underside thereof during reciprocation of said slide; a second guideway for said slide for reciprocation therealong during firing, positioned above said slide and releasably connected with said base so as to be removable when the pistol is taken apart; said second guideway including a plate having one bearing surface cooperating with the surface of said slide at the top thereof; said base having a channel corresponding to the shape of said slide, said plate being pivotably mounted on said base for movement between a raised position and a lowered position, said plate in the lowered position being operative to guide the top surface of the slide, said plate in the raised position blocking viewing through said sighting device and preventing operation of said firing and triggering mechanism.

2. A pistol as claimed in claim 1 wherein said base includes spaced side jaws in which said plate is pivotably mounted.

3. A pistol as claimed in claim 2 comprising releasable locking means carried by said plate for locking the same to said base in said lowered position.

4. A pistol as claimed in claim 3 wherein said jaws are provided with aligned operings, said plate including journals at the sides thereof rotatably engaged in said openings.

5. A pistol as claimed in claim 4 wherein one of said jaws is provided with a slot to enable insertion of the plate between said jaws.

6. A pistol as claimed in claim 4 wherein said releasable locking means comprises a spring-loaded pin mounted in said plate and urged laterally outwards thereof at one of its sides, said jaw having a groove shaped to receive a projection on the other side of said plate, said projection being releasable from said groove by displacement of the spring-loaded pin against the action of the spring-loading thereof whereby the plate is now movable to said raised position by rotation of said journals in said openings.

* * * * *